US009985349B1

(12) United States Patent
He

(10) Patent No.: US 9,985,349 B1
(45) **Date of Patent: *May 29, 2018**

(54) MULTI-BAND LTE ANTENNA

(71) Applicant: Airgain Incorporated, San Diego, CA (US)

(72) Inventor: Ziming He, Irvine, CA (US)

(73) Assignee: Airgain Incorporated, San Diego, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/161,060

(22) Filed: May 20, 2016

Related U.S. Application Data

(63) Continuation of application No. 14/071,571, filed on Nov. 4, 2013, now Pat. No. 9,362,621, and a continuation-in-part of application No. 29/457,103, filed on Jun. 6, 2013, now Pat. No. Des. 692,870.

(60) Provisional application No. 61/826,981, filed on May 23, 2013.

(51) Int. Cl.

| | |
|---|---|
| ***H01Q 1/24*** | (2006.01) |
| ***H01Q 5/10*** | (2015.01) |
| ***H01Q 1/48*** | (2006.01) |
| ***H01Q 15/14*** | (2006.01) |
| ***H01Q 1/50*** | (2006.01) |

(52) U.S. Cl.
CPC ..... *H01Q 5/10* (2015.01); *H01Q 1/242* (2013.01); *H01Q 1/48* (2013.01); *H01Q 1/50* (2013.01); *H01Q 15/14* (2013.01)

(58) Field of Classification Search
CPC ..... H01Q 1/243; H01Q 1/242; H01Q 1/38; H01Q 1/48; H01Q 15/14; H01Q 1/50; H01Q 5/10
USPC ..... 343/700 MS, 702
See application file for complete search history.

(56) References Cited

U.S. PATENT DOCUMENTS

| | | | | |
|---|---|---|---|---|
| 6,184,834 | B1 * | 2/2001 | Utsumi | H01Q 1/22 343/700 MS |
| 6,343,208 | B1 * | 1/2002 | Ying | H01Q 1/243 343/702 |
| 9,362,621 | B1 * | 6/2016 | He | H01Q 5/001 |
| 2005/0275595 | A1 * | 12/2005 | Endo | H01Q 1/2258 343/702 |
| 2007/0008224 | A1 * | 1/2007 | Chung | H01Q 1/243 343/700 MS |
| 2009/0243947 | A1 * | 10/2009 | Tsai | H01Q 1/2291 343/742 |
| 2010/0134376 | A1 * | 6/2010 | Margomenos | H01P 5/028 343/848 |

* cited by examiner

*Primary Examiner* — Dieu H Duong
(74) *Attorney, Agent, or Firm* — Clause Eight IPS; Michael Catania

(57) ABSTRACT

A surface-mounted multi-band LTE antenna that covers the frequency band of 698-960 MHz (LTE 700/800/900 bands) and 2400-2500 GHz (WLAN 2.4G band) is disclosed herein. The antenna preferably has high gain and high radiation efficiency, and is used for a variety of wireless communication devices applications. The surface-mounted multi-band LTE antenna has compact size, wide bandwidth, good return loss, high gain and high radiation efficiency, and no matching circuit is needed.

4 Claims, 8 Drawing Sheets

| | |
|---|---|
| Type | Farfield |
| Approximation | enabled (kr >> 1) |
| Monitor | farfield (f=0.829) [1] |
| Component | Abs |
| Output | Directivity |
| Frequency | 0.829 |
| Rad. effic. | -0.2710 dB |
| Tot. effic. | -0.2957 dB |
| Dir. | 3.042 dBi |

MULTI-BAND LTE ANTENNA

CROSS REFERENCES TO RELATED APPLICATIONS

The Present Application is a continuation application of U.S. patent application Ser. No. 14/071,571, filed on Nov. 4, 2013, which claims priority to U.S. Provisional Application No. 61/826,981, filed May 23, 2013, and is a continuation-in-part application of U.S. patent application Ser. No. 29/457,103, filed on Jun. 6, 2013, now U.S. Pat. No. D692870, issued on Nov. 5, 2013, all of which are hereby incorporated by reference in their entireties.

STATEMENT REGARDING FEDERALLY SPONSORED RESEARCH OR DEVELOPMENT

Not Applicable

BACKGROUND OF THE INVENTION

Field of the Invention

The present invention generally relates to antennas. More specifically, the present invention relates to the architecture of a surface-mounted multi-band LTE antenna that covers the frequency band of 698-960 MHz (LTE 700/800/900 bands) and 2400-2500 MHz (WLAN 2.4G band). The antenna has high gain and high radiation efficiency, and is used for a variety of wireless communication devices applications.

Description of the Related Art

The prior art discusses various antennas.

Current wireless communication devices such as cellular phone, laptop, tablet computer etc. have an increasing demand for multi-band, high gain, high efficiency and compact size LTE antennas. However, in most cases the design of multi-band LTE antenna is very difficult, especially when the LTE700/800/900 bands are included, since it is very hard to get enough bandwidth with good return loss for each frequency band.

General definitions for terms utilized in the pertinent art are set forth below.

BLUETOOTH technology is a standard short range radio link that operates in the unlicensed 2.4 gigahertz band.

Code Division Multiple Access ("CDMA") is a spread spectrum communication system used in second generation and third generation cellular networks, and is described in U.S. Pat. No. 4,901,307.

GSM, Global System for Mobile Communications is a second generation digital cellular network.

The Universal Mobile Telecommunications System ("UMTS") is a wireless standard.

Long Term Evolution ("LTE") is a standard for wireless communication of high-speed data for mobile phones and data terminals and is based on the GSM/EDGE and UMTS/HSPA communication network technologies.

LTE Frequency Bands include 698-798 MHz (Band 12, 13, 14, 17); 791-960 MHz (Band 5, 6, 8, 18, 19, 20); 1710-2170 MHz (Band 1, 2, 3, 4, 9, 10, 23, 25, 33, 34, 35, 36, 37, 39); 1427-1660.5 MH (Band 11, 21, 24); 2300-2700 MHz (Band 7, 38, 40, 41); 3400-3800 MHz (Band 22, 42, 43).

Antenna impedance and the quality of the impedance match are most commonly characterized by either return loss or Voltage Standing Wave Ratio.

Surface Mount Technology ("SMT") is a process for manufacturing electronic circuits wherein the components are mounted or placed directly onto a surface of a printed circuit board ("PCB").

The APPLE IPHONE® 5 LTE Bands include: LTE700/1700/2100 (698-806 MHz/1710-1785 MHz/1920-2170 MHz); LTE 850/1800/2100 (824-894 MHz/1710-1880 MHz/1920-2170 MHz); and LTE 700/850/1800/1900/2100 (698-806 MHz/824-894 MHz/1710-1880 MHz/1850-1990 MHz/1920/2170).

The SAMSUNG GALAXY® SIII LTE Bands include: LTE 800/1800/2600 (806-869 MHz/1710-1880 MHz/2496-2690 MHz.

The NOKIA LUMIA® 920 LTE Bands: LTE 700/1700/2100 (698-806 MHz/1710-1785 MHz/1920-2170 MHz); LTE 800/900/1800/2100/2600 (806-869 MHz/880-960 MHz/1710-1880 MHz/1920-2170 MHz/2496-2690 MHz).

For wireless communication devices applications, there are generally three challenging requirements for embedded antenna: good performance, compact size and low cost. What is needed is an antenna that can meet the needs of the LTE/WiFi mobile device market.

BRIEF SUMMARY OF THE INVENTION

In some wireless mobile devices, both LTE and WiFi capabilities are required. To meet such needs, a surface-mounted multi-band antenna that covers the LT low band (LTE 700/800/850/900, that is 698-960 MHz) and WiFi 2G band (2.4-2.49 GHz) is presented in this invention.

The present invention provides a solution to the needs of the LTE mobile device market in the form of a multi-band antenna. This surface-mounted multi-band LTE antenna has compact size, wide bandwidth, good return loss, high gain and high radiation efficiency, and no matching circuit is needed. The multi-band LTE/WLAN chip antenna of the present invention meets the needs of market: 698-960 MHz (LTE700/800/850/900) and 2400-2500 GHz (WLAN 2G).

In the present invention, a surface-mounted multi-band LTE antenna with high gain and high efficiency for wireless communication devices applications is presented. The radiation efficiency is greater than 60% respectively in all frequency bands it covered. In addition, since the antenna is built with PCB, it is easy for high volume production and to build high gain array antennas.

One aspect of the present invention is a multi-band LTE antenna. The LTE antenna includes a main section, a first branch section, a second branch section, a third branch section, and a fourth branch section. The main section has a length greater than the first branch section. The first branch section has a length greater than the second branch section. The second branch section has a length greater than the third branch section. The third branch section has a length greater than the fourth branch section.

The multi-band LTE antenna preferably covers the frequency band of 698 to 960 MHz and the frequency band of 2400 to 2500 Ghz.

Preferably, the multi-band LTE antenna has a return loss greater than −5 dB across an operating frequency ranging from 698 MHz to 960 MHz and a return loss greater than −9.3 dB across an operating frequency ranging from 2400 to 2500 GHz.

The main section of the antenna has a length ranging from 50 mm to 75 mm and has a height ranging from 1 mm to 3 mm.

The multi-band LTE antenna includes a ground pin, a feed pin, a first floating pin, a second floating pin, a third floating pin and a fourth floating pin.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1A:
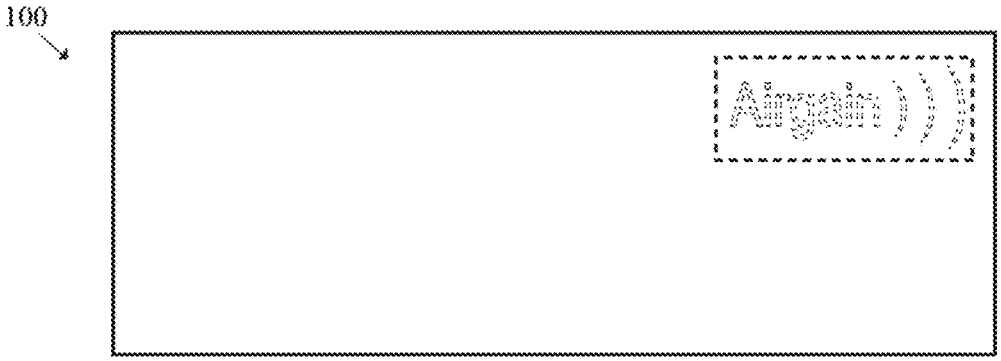
FIG. 1A is a top view of a multi-band LTE antenna with an antenna element within a housing.
Figure 1B:
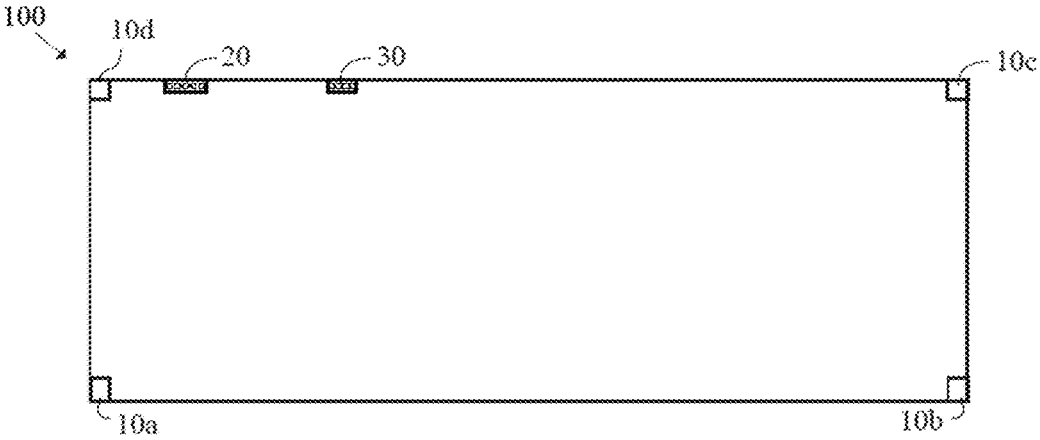
FIG. 1B is a bottom view of a multi-band LTE antenna with an antenna element within a housing.
Figure 2:
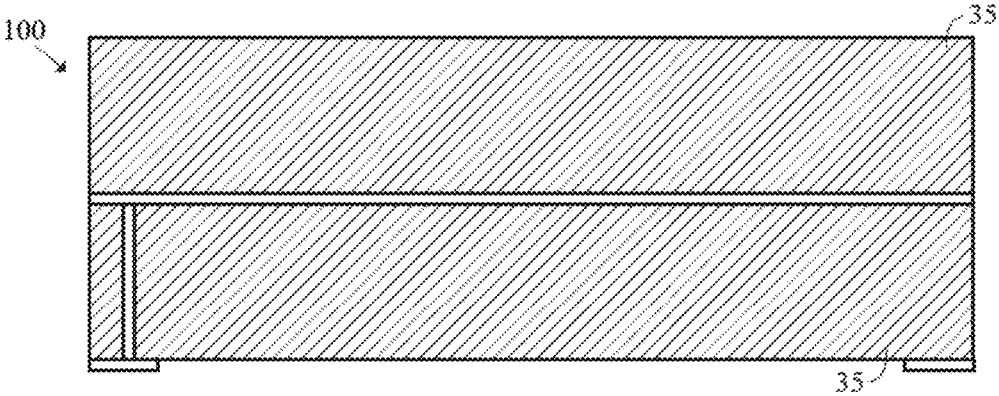
FIG. 2 is a right side view of a multi-band LTE antenna with an antenna element within a housing.
Figure 3:
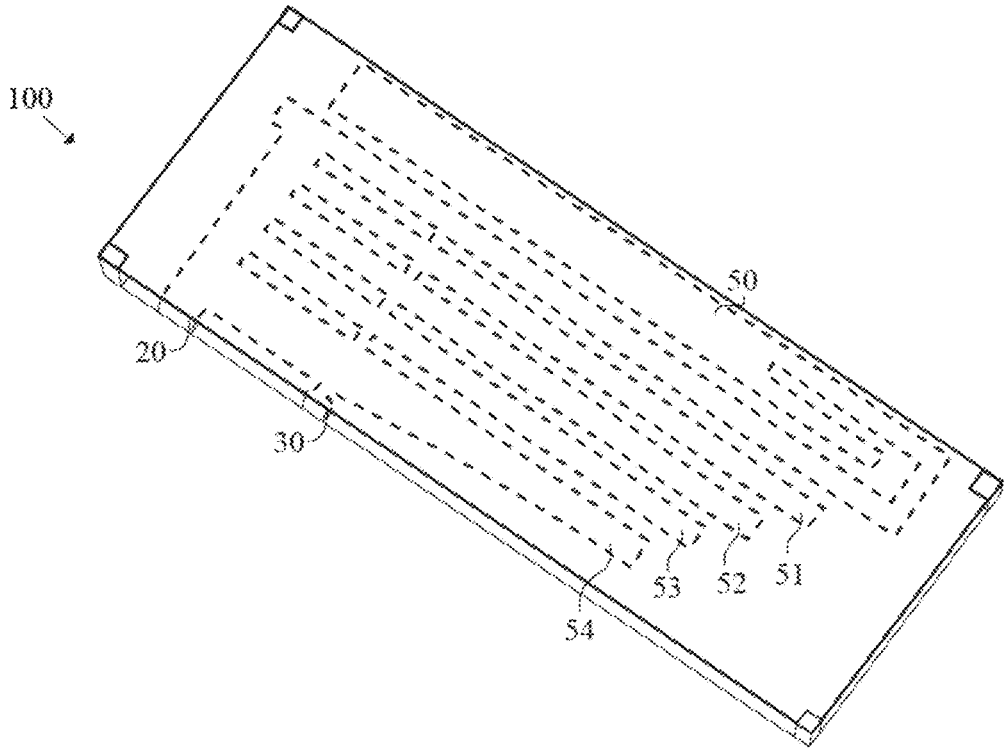
FIG. 3 is an isolated view of an antenna element of a multi-band LTE antenna.

The multi-band LTE antenna of the present invention is preferably a surface mount type antenna structure, and is easy to mount on customer circuit PCB by a surface-mount technology (SMT) process. The architecture of the surface-mounted multi-band LTE antenna is shown in FIG. 1 through FIG. 3, and the multi-band LTE antenna, prior to mounting, is shown in FIG. 4 through FIG. 7. The antenna is sealed in the middle layer of two 60 mil FR4 PCBs 35, shown in the antenna side view FIG. 2, and six pins are exposed, shown in the antenna bottom view FIG. 1B. FR-4 is a woven glass and epoxy dielectric material for a PCB.

The six pins comprise a feeding pin 30, a grounding pin 20, and four floating pins 10*a*-10*d* that are mainly used for increasing the soldering strength on the PCB. The four floating pins 10*a*-10*d* have a certain influence on antenna performance. The antenna is connected to RF front-end circuit of a wireless communication device either with a 50 ohm micro-strip line or a 50 ohm coaxial cable, and no impedance matching circuit is needed. The multi-band antenna is preferably soldered on a customer circuit PCB by a SMT machine process.

The dimension of the multi-band LTE antenna depends on the lowest operation frequency and the PCB substrate material used (FR4 or other high dielectric substrate material such as Taconic CER-10 (εr=10)). The multi-band LTE antenna covers the frequency bands of 698-960 MHz and 2400-2500 GHz.

The preferred multi-band LTE antenna dimensions with the housing with FR4 (Er=4.4): 71.5×23.5×3.1 mm.

The preferred multi-band LTE antenna dimensions with the housing with CER-10 (Er=10): 60.5×23.5×3.1 mm (L×W×H).

Figure 4:
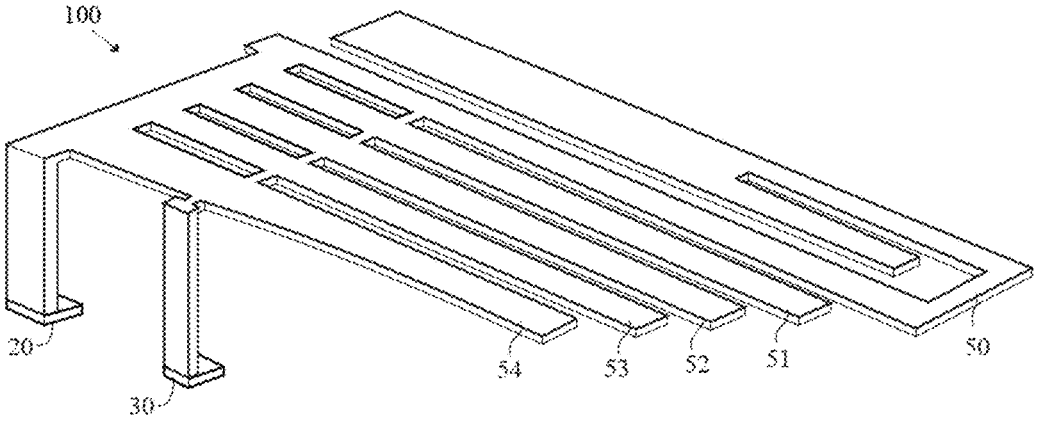
FIG. 4 is a top perspective view of an antenna.
Figure 5:
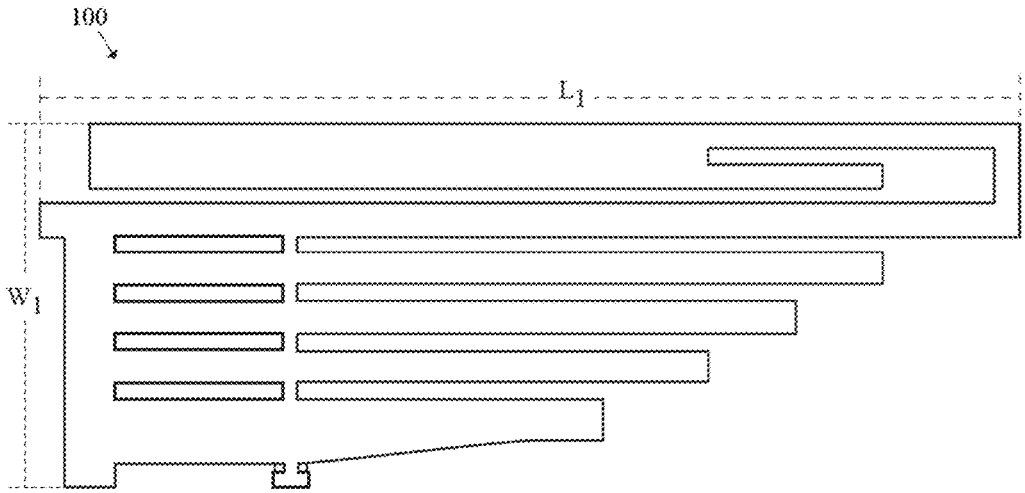
FIG. 5 is a top plan view of the antenna of FIG. 1.
Figure 6:
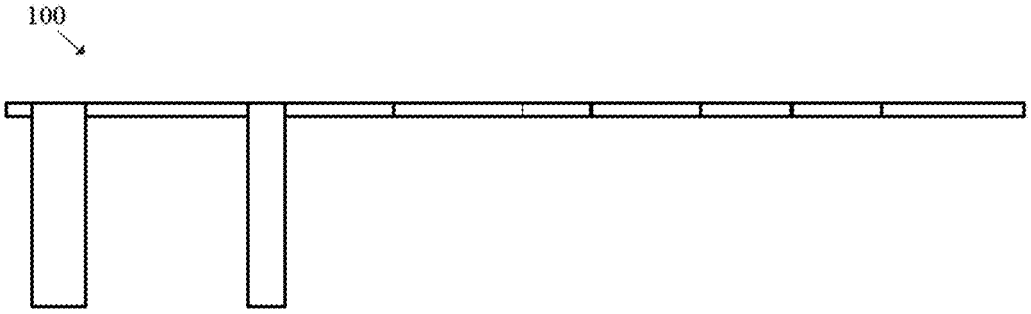
FIG. 6 is a front side view of the antenna of FIG. 1.
Figure 7:
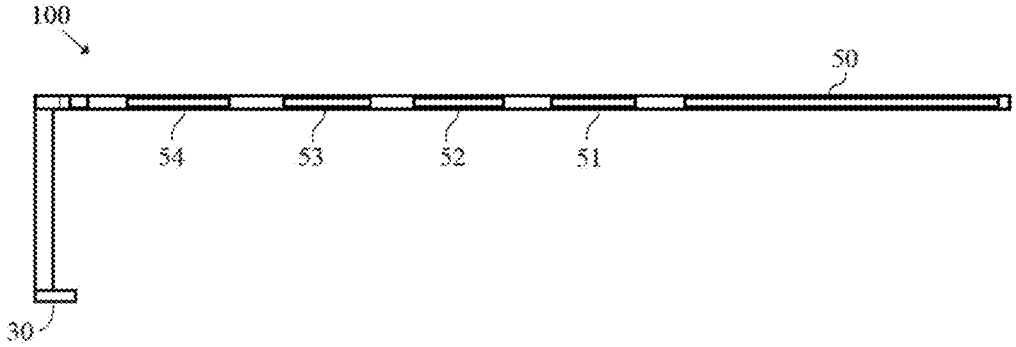
FIG. 7 is a right side view of the antenna of FIG. 1.

FIG. 4 through FIG. 7 show the antenna before being mounted. FIG. 4 shows a top perspective view of an antenna. FIG. 5 shows a top plan view, FIG. 6 shows a side view of the antenna, facing the feed pin 30 and grounding pin 20. FIG. 7 shows another side view of the antenna, facing the branches.

The detailed structure of the multi-band LTE antenna 100 and dimensions $L_2$ and $H_2$ are shown in FIG. 4. The antenna comprises of one main antenna 50 and four parasitic branches (Branch 1 51, Branch 2 52, Branch 3 53 and Branch 4 54). The main antenna 50 controls the frequencies of low band and high band, and the four parasitic branches 51-54 help to increase the low and high band width of the multi-band LTE antenna 100. By adjusting the distance between feed pin 30 and grounding pin 20, the input return loss of the antenna is improved.

The main section 50 of the antenna has the greatest length $L_2$ over the other branches 51-54 ranging from 50-75 mm and has a height $H_2$ ranging from 1-3 mm. As shown in FIGS. 4-5, the branch length decreases the further away the branch is from the main section 50. Branch 4 54 has the shortest length, Branch 3 53 has a length greater than Branch 4 54, Branch 2 52 has a length greater than Branch 3 53, and Branch 1 51 has a length greater than Branch 2 52.

The unique antenna structure of the multi-band LTE antenna of the present invention, shown in the aforementioned figures, FIG. 1-FIG. 7, has a very wide bandwidth, and is able to cover the entire LTE low band (698-960 MHz) and other high bands. The multi-band LTE antenna of the present invention has good return loss, a high gain, a high efficiency and a compact size.

Figure 8:
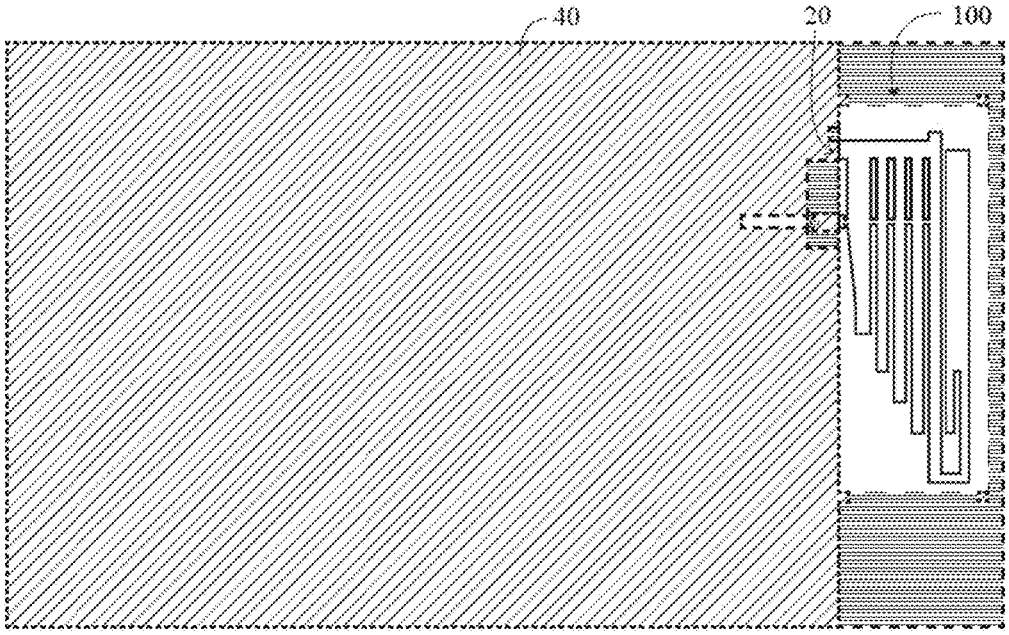
FIG. 8 is an illustration of a multi-band LTE antenna connected to a circuit board.

FIG. 8 shows the antenna of the present invention mounted on an evaluation PCB board. The performance of the multi-band LTE antenna 100 on an evaluation PCB 40 (60 mil FR4, ½ oz copper) with dimensions of 150×92×1.6 mm was simulated with Computer Simulation Technology (CST) software.

Figure 9:
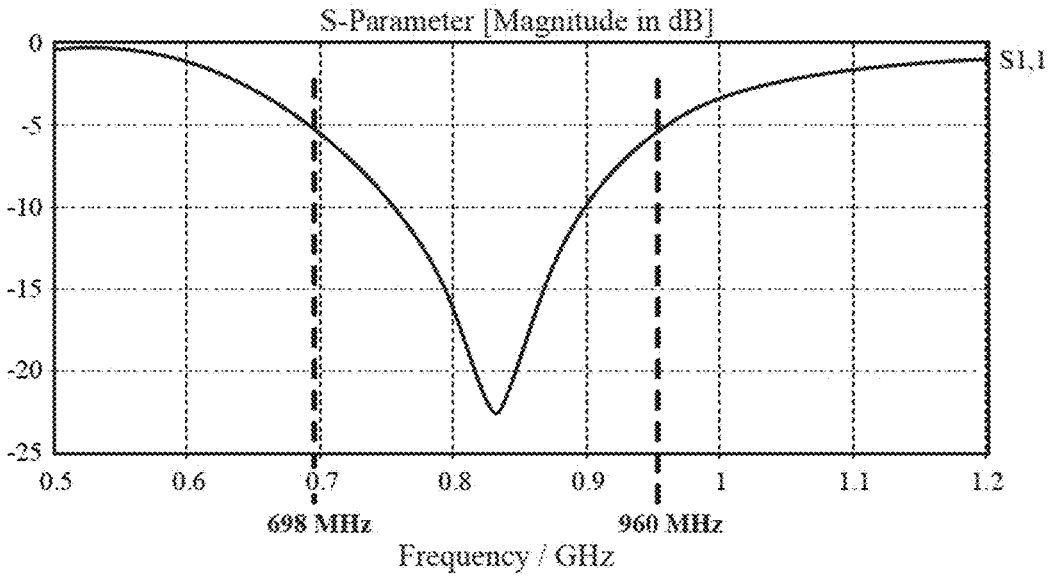
FIG. 9 is a graph of return loss of low band (698 MHz-960 MHz) with a FR4 PCB.

The simulated return loss of low band is shown in FIG. 9. Antenna return loss is better than −5 dB across the operating frequency band of 698-960 MHz, without the need for an impedance matching circuit.

Figure 10:
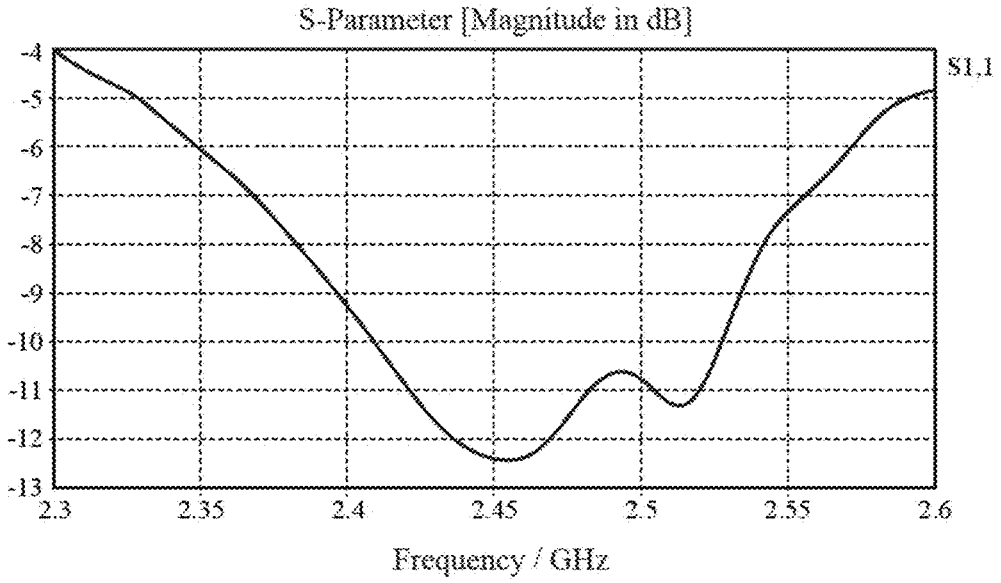
FIG. 10 is a graph of return loss of high band (2.4 GHz-2.5 GHz) with a FR4 PCB.

The simulated return loss of high band is shown in FIG. 10. Antenna return loss is better than −9.3 dB across the operating frequency band of 2400-2500 MHz without the need for an impedance matching circuit.

Figure 11:
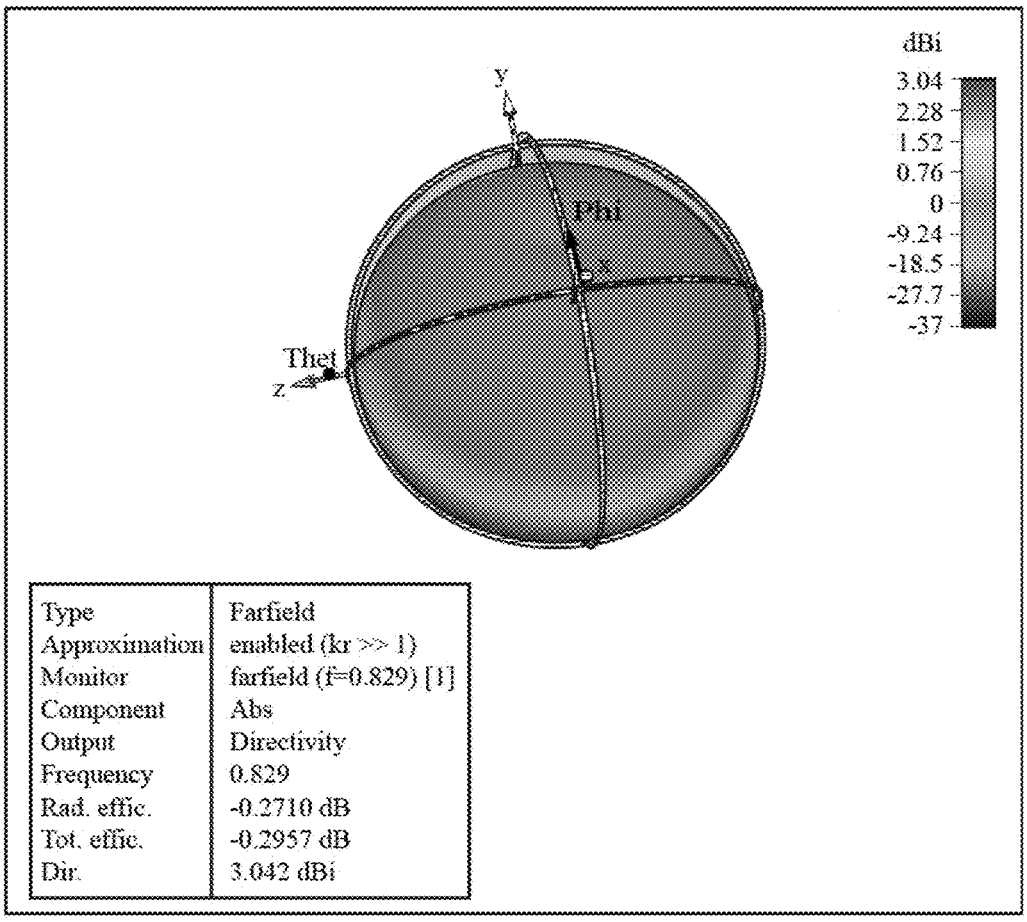
FIG. 11 is a graph of peak directivity and efficiency at 829 MHz.

The simulated 3D radiation pattern and peak gain at 829 MHz is shown in FIG. 11. The peak gain at 829 MHz is +2.77 dBi. The simulated radiation efficiency is 93.95% at 829 MHz.

Figure 12:
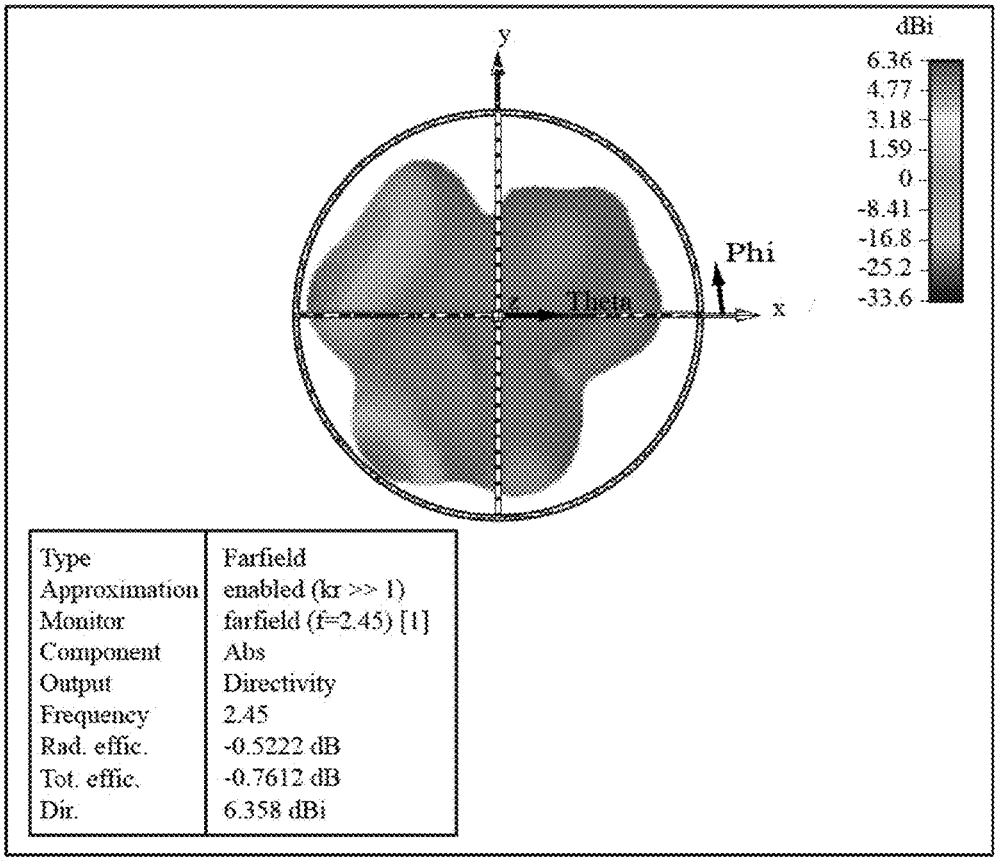
FIG. 12 is a graph of peak directivity and efficiency at 2.45 GHz.

The simulated 3D radiation pattern and peak gain at 2.45 GHz is shown in FIG. 12. The peak gain is +5.84 dBi at 2.45 GHz and the simulated radiation efficiency is 88.67% at 2.45 GHz.

The dimensions of the PCB grounding plane size has a strong influence on antenna performance. In practical applications, to maintain high gain, the dimensions of the PCB should be greater than ¼ wavelength of the lowest operation frequency.

To reduce antenna dimensions, PCB substrate with high dielectric constant can be used. The comparison of antenna performance with FR4 and Taconic CER-10 is shown in Table 1.

TABLE 1

| Antenna Parameters | With FR4 PCB | | With CER-10 PCB | |
|---|---|---|---|---|
| Frequency band | 698-960 MHz | 2.4-2.5 GHz | 698-960 MHz | 2.4-2.5 GHz |
| Return Loss | <−6 dB | <−10 dB | <−5 dB | <−8 dB |
| Peak Gain | 2.25-3.05 dBi | 4.97-5.84 dBi | 2.49-3.14 dBi | 4.6-5.53 dBi |
| Efficiency | >60% | >60% | >60% | >60% |
| Impedance (Ω) | 50 | 50 | 50 | 50 |
| Antenna dimensions | 71.5 × 23. 5 × 3.1 mm | | 60.5 × 23.5 × 3.1 mm | |

Especially notable is that by adding a reflector under the antenna the antenna peak gain can be increased 2 to 3 dB. In addition, it is easy to build high gain array antennas for different applications with the surface mounted multi-band LTE antenna. In the present invention, the architecture and principle can be applied to other frequency bands and other applications From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

I claim as my invention:

1. A multi-band LTE antenna comprising:

a main section having a length ranging from 50 mm to 75 mm;

a plurality of branch sections, each of the plurality of branch sections parallel to the main section and having a length less than an adjacent branch section;

a feed pin;

a grounding pin;

wherein the main section has a length greater than the length of each of the plurality of branch sections, wherein the main section has a length greater than a first branch section, the first branch section has a length greater than a second branch section, the second branch section has a length greater than a third branch section, and the third branch section has a length greater than a fourth branch section;

wherein the feed pin and the grounding pin are attached to the fourth branch section of the plurality of branch sections, the fourth branch section having the shortest length of the plurality of branch sections, the feed pin and the grounding pin positioned on different plane from main section and the plurality of branch sections;

wherein the antenna covers the frequency band of 698 MegaHertz (MHz) to 960 MHz and the frequency band of 2.4 GigaHertz (GHz) to 2.5 GHz;

wherein the antenna has a return loss greater than −5 dB across an operating frequency ranging from 698 MHz to 960 MHz;

wherein the antenna has a return loss greater than −9.3 dB across an operating frequency ranging from 2.4 GHz to 2.5 GHz;

wherein the main branch controls the frequencies of 698 MHz to 960 MHz and 2.4 GHz to 2.5 GHz, and the plurality of branch sections increase the low and high band width.

2. The antenna according to claim 1 further comprising a first floating pin, a second floating pin, a third floating pin and a fourth floating pin.

3. A wireless communication device comprising:

a printed circuit board;

a LTE multi-band antenna comprising a radiation element comprising a plurality of radiation branches, each of the plurality of radiation branches parallel to each and having a length less than an adjacent radiation branch of the plurality of radiation branches, wherein the main section has a length greater than a first branch section, the first branch section has a length greater than a second branch section, the second branch section has a length greater than a third branch section, and the third branch section has a length greater than a fourth branch section;

a feed pin and a grounding pin positioned on different plane from main section and the plurality of branch sections;

wherein the antenna covers the frequency band of 698 MegaHertz (MHz) to 960 MHz and the frequency band of 2.4 GigaHertz (GHz) to 2.5 GHz;

wherein the antenna has a return loss greater than −5 dB across an operating frequency ranging from 698 MHz to 960 MHz;

wherein the antenna has a return loss greater than −9.3 dB across an operating frequency ranging from 2.4 GHz to 2.5 GHz;

wherein the LTE multi-band antenna is connected to a RF front-end circuit of the wireless communication device.

4. The wireless communication device according to claim 3 further comprising a reflector board.

* * * * *